US006467619B1

(12) United States Patent
Leen et al.

(10) Patent No.: US 6,467,619 B1
(45) Date of Patent: Oct. 22, 2002

(54) MULTIPLE HALOGEN LAMP STORAGE CONTAINER

(76) Inventors: Corey Leen; Teresa Leen, both of 1429 Forester Blvd. SW., North Bend, WA (US) 98045

( * ) Notice: Subject to any disclaimer, the term of this patent is extended or adjusted under 35 U.S.C. 154(b) by 0 days.

(21) Appl. No.: 09/670,042

(22) Filed: Sep. 25, 2000

(51) Int. Cl.[7] ..... B65D 85/42

(52) U.S. Cl. ..... 206/421; 206/422; 206/523; 206/592

(58) Field of Search ..... 206/418–422, 206/523, 521, 591, 592, 594

(56) References Cited

U.S. PATENT DOCUMENTS 3,286,834 A * 11/1966 English, Jr. ..... 206/523
4,106,597 A * 8/1978 Shook et al. ..... 206/523
4,613,042 A 9/1986 Aeschliman
4,763,791 A * 8/1988 Halverson et al. ..... 206/523
5,040,678 A * 8/1991 Lenmark, Sr. et al. ..... 206/523
5,515,971 A 5/1996 Segrest
5,607,230 A 3/1997 Protz, Jr.
5,695,057 A 12/1997 Sullivan
6,036,019 A * 3/2000 Silverman ..... 206/523

* cited by examiner

*Primary Examiner*—Luan K. Bui
(74) *Attorney, Agent, or Firm*—Dean A. Craine

(57) ABSTRACT

A compact, multiple halogen bulb storage container used to temporarily hold and protect a plurality of halogen bulbs. The container includes an outer, rigid box with a closable lid. Disposed inside the rigid case is an insert designed to hold a plurality of halogen bulbs in a spaced-apart, longitudinally aligned configuration. The insert may be made of elastic or rigid foam material that completely fills the inside central space in the rigid box. In one embodiment, the bulb receiving spaces are aligned on the top surface of the insert holder insert so that the bulb may be horizontally aligned and vertically inserted in to the bulb receiving space. In a second embodiment, the insert is longitudinally aligned in the rigid case with the bulb receiving spaces longitudinally aligned inside the bulb holder. The bulbs slide through the end of the bulb receiving space. Each embodiment includes at least one bulb end space formed near the exposed end of the bulb receiving space that enables a user to easily grasp the end of the halogen bulb to remove it from the insert.

3 Claims, 3 Drawing Sheets

MULTIPLE HALOGEN LAMP STORAGE CONTAINER

BACKGROUND OF THE INVENTION

1. Field of the Invention

This invention pertains to containers used to store or transport light bulbs, and more particularly, to temporary storage means for halogen bulbs designed to be carried in a workman's toolbox or belt.

2. Description of the Related Art

Halogen bulbs are known in the industry and are desirable for their bright and long lasting light. Unfortunately, halogen bulbs are considerably more expensive and more fragile than other types of electric light bulbs.

Typically, halogen bulbs used in work lights are thin, elongated tubes with ceramic-encased terminal ends. Such bulbs typically measure 4-⅝ inches in length and ⅜ inch in diameter. The bulbs may be sold individually or in packages containing two or more bulbs. Because the cost per bulb is usually lower when purchased in bulk, frequent users of work lights usually purchase packages containing multiple bulbs. Although the bulbs are reasonably protected from breakage while in their original package in the store, the original package does not provide adequate protection for storage in a toolbox or carrying belt.

It is widely known that halogen bulbs must be carefully handled so that oil and/or dirt from the user's fingers are not deposited on the sides of the body of the bulb. Most halogen bulb manufacturers recommend that the user only grasp the ceramic-encased terminal ends of the bulb when handling.

What is needed is a storage container that allows a user to store a plurality of elongated halogen bulbs used in work lights that not only protects the individual bulbs, but also allows the user to easily insert and remove a bulb from the storage container by grasping only the terminal end of the bulb.

SUMMARY OF THE INVENTION

It is an object of the present invention to provide a protective storage container for a plurality of halogen bulbs.

It is another object of the present invention to provide such a storage container that allows easy insertion and removal of an individual bulb from the storage container by allowing the user to grasp only the terminal end of the bulb.

These and other objects of the invention which will become apparent are met by a storage container designed to store a plurality of elongated halogen bulbs used in work lights. The storage container comprises an outer, rigid box with a removable lid, a protective insert designed to fit snuggly inside the empty, centrally formed space inside the box, a plurality of elongated halogen bulb receiving spaces formed in the insert designed to hold a plurality of halogen bulbs in a spaced-apart, protective location, and at least one halogen bulb end recess space formed on each halogen bulb receiving space designed to allow the user to grasp the terminal end of each halogen bulb when inserting and removing a bulb from the halogen bulb receiving space.

DESCRIPTION OF THE PREFERRED EMBODIMENT(S)

Figure 2:
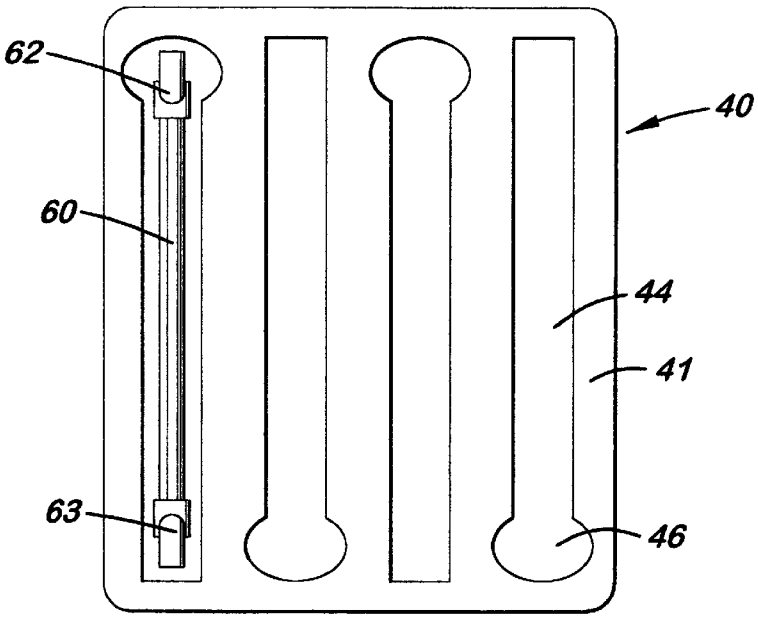
FIG. 2 is a top plan view of the insert in the first embodiment of the invention.
Figure 1:
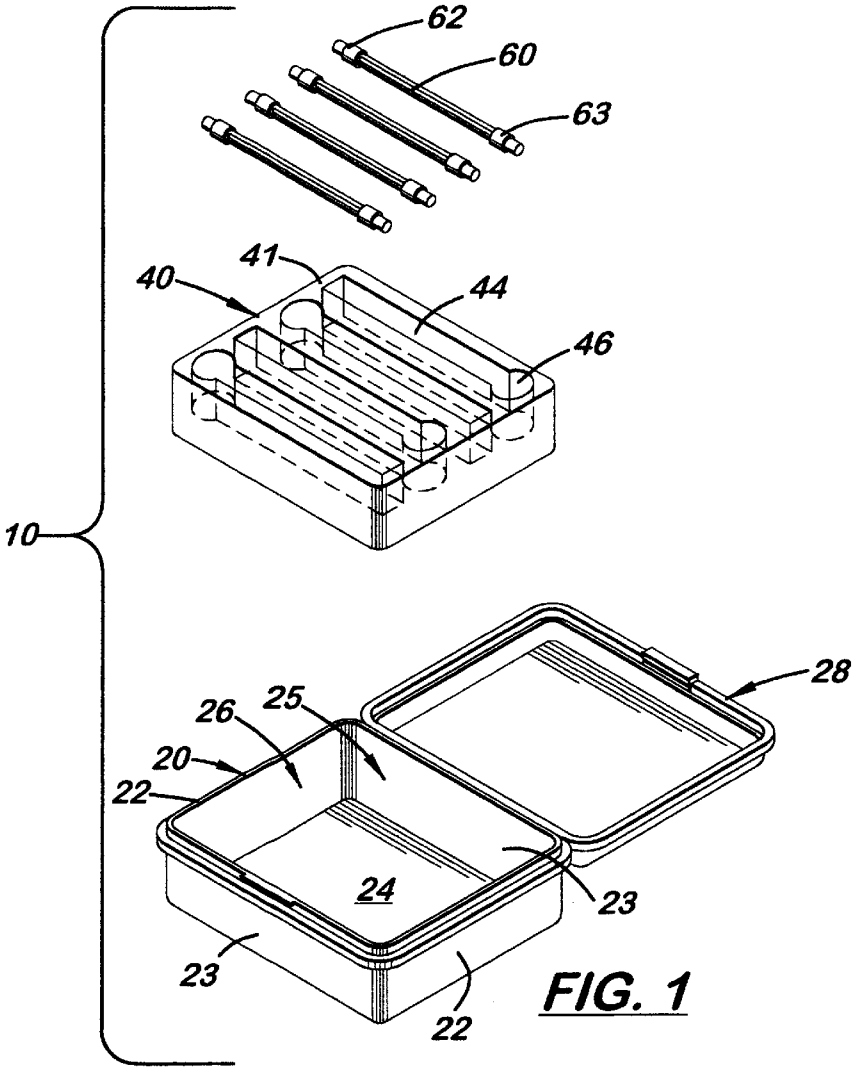
FIG. 1 is a perspective view of the first embodiment of the multiple halogen bulb storage container.

Referring to the accompanying Figs., there is shown and described a compact, multiple halogen bulb storage container, generally referred to as 10, used to temporarily store a plurality of halogen bulbs 60. In the first embodiment shown in FIG. 1, the storage container 10 includes an outer flat rigid box 20 with two vertical sidewalls 22, two vertical end walls 23 and a flat bottom surface 24 extending therebetween. Located opposite the bottom surface 24 is a wide top opening 25 over which a rigid lid 28 is selectively attached. Formed inside the box 20 is an empty central space 26.

Placed inside the central space 26 of the rigid box 20 is a snugly fitting, square or rectangular shaped insert 40. In the first embodiment, the insert 40 is made of elastic foam material and includes a plurality of bulb receiving spaces 44 formed therein. The spaces 44 are aligned in a parallel manner and are spaced-apart evenly across the upper surface 41 of the insert 40. Each bulb receiving space 44 is closed at its opposite ends, is square or semi-circular in cross-section, and is sufficient in length to hold one elongated, dual terminal ended halogen bulb 60. Formed on at least one end of the bulb receiving space 44 is a wide halogen bulb end recess space 46 which enables the user to grasp the terminal ends 62, 63 of the bulb 60 when inserting or removing the bulb 60 from a bulb receiving space 44. In the preferred embodiment, the location of the halogen bulb end recess space 46 is alternated on opposite ends on adjacent bulb receiving spaces 44 so that the bulb receiving spaces 44 can be more compactly arranged on the insert 40. Also the depth of each bulb receiving space 44 is sufficient so that the upper surface of a bulb 60 does not contact the inside surface of the lid 28 when closed over the box 20.

Figure 4:
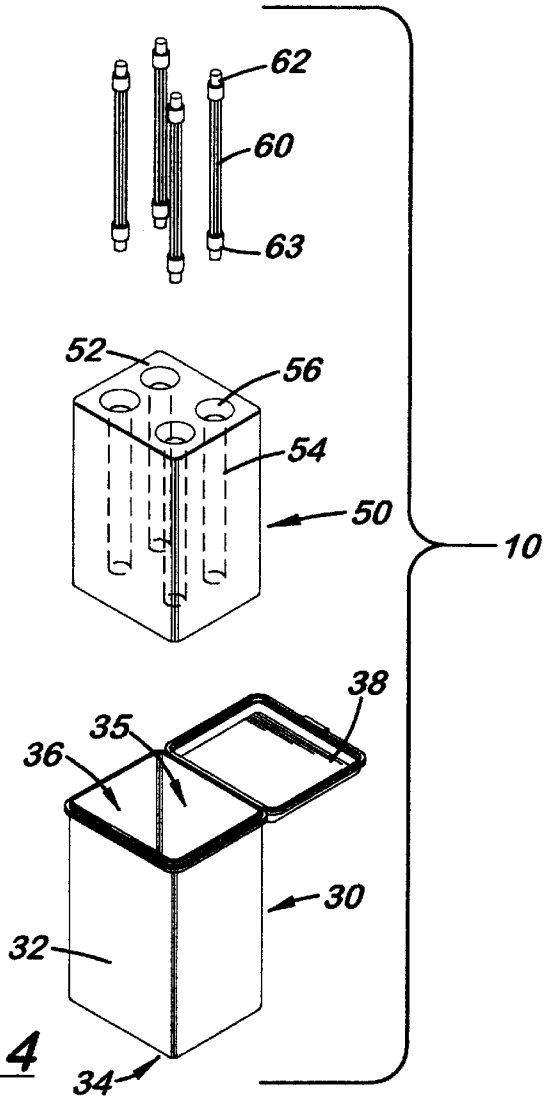
FIG. 4 is an exploded, perspective view of a second embodiment of the storage container.
Figure 3:
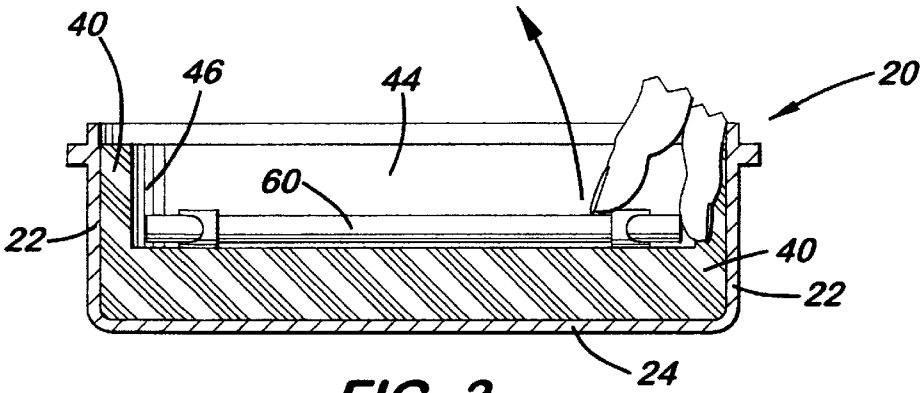
FIG. 3 is a sectional side elevational view showing a halogen bulb being removed from the insert show in FIGS. 1 and 2.
Figure 6:
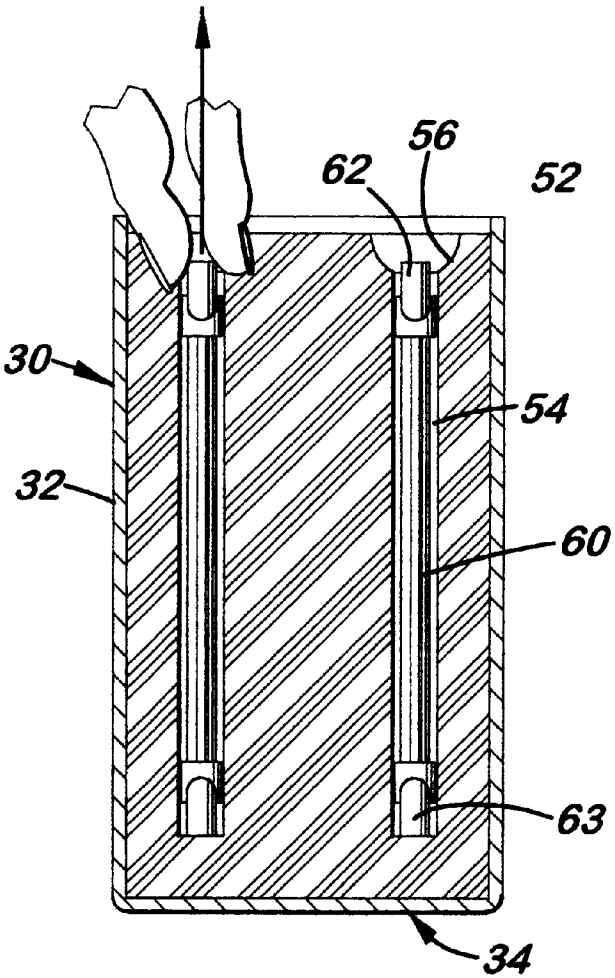
FIG. 6 is a sectional side elevational view showing a halogen bulb being removed from the insert shown in FIGS. 4 and 5.
Figure 5:
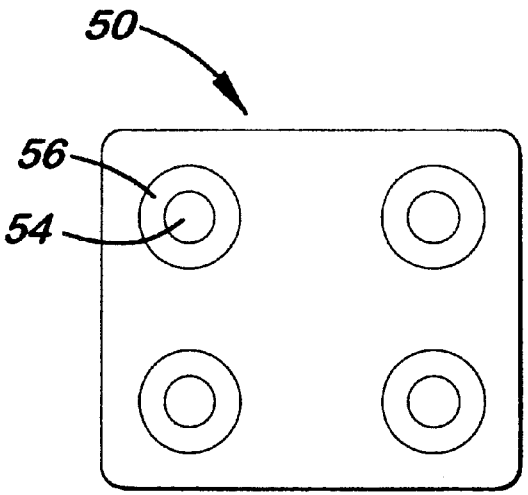
FIG. 5 is a top plan view of the insert used in the second embodiment.

In the second embodiment, shown in FIGS. 4 and 5, the rigid box 30 is elongated with a central space 36 designed to receive longitudinally an elongated foam insert 50. Box 30 includes four sidewalls 32 and a flat bottom surface 34. Located opposite the bottom surface 34 is a top opening 35. A rigid lid 38 is selectively attached over the top opening 35. Formed in the insert 50 is a plurality of longitudinally aligned, cylindrical-shaped bores 54. The bores 54 extend longitudinally from the top end surface 52 of the insert 50 to the opposite end 55 closed inside the insert 50. Formed on the upper end of each bore 54 is a wide finger cutout 56 similar to the recess space 46 used on insert 40.

In compliance with the statute, the invention has been described herein in language more or less specific as to structural features. It should be understood, however, that the invention is not limited to the specific features shown, since the means and construction shown, comprise only the preferred embodiments for putting the invention into effect. The invention is therefore claimed in any of its forms or modifications within the legitimate and valid scope of the amended claims, appropriately interpreted in accordance with the doctrine of equivalents.

We claim:

1. A multiple halogen bulb storage container, comprising:

a. an outer rigid box with a closeable lid, said rigid box having a main opening and a central space formed therein;

b. an elastic foam insert inserted through said main opening and disposed inside said central space in said rigid box, said insert designed to fit snugly inside said central space and having an end surface;

c. a plurality of parallel, elongated halogen bulb receiving spaces formed inside said insert, each capable of receiving an elongated halogen bulb, said halogen bulb receiving spaces being evenly spaced apart and beginning at said end surface and extending longitudinally inside said insert;

d. at least one wide halogen bulb end recess space formed on each said halogen bulb receiving space thereby exposing a terminal end of a halogen bulb when placed into said halogen bulb receiving space to enable a user to grasp the terminal end of a halogen bulb; and, e. a halogen bulb longitudinally aligned inside each said halogen bulb receiving space.

2. The multiple halogen bulb storage container, as recited in claim 1, wherein said halogen bulb end recess spaces are located on opposite ends on adjacent said halogen bulb receiving spaces.

3. A multiple halogen bulb storage container, comprising:

a. an outer rigid box with a closeable lid, said rigid box having a main opening and a central space formed therein;

b. an insert made of elastic foam disposed inside said central space in said outer rigid box, said insert having a top surface;

c. a plurality of parallel, semi-circular halogen bulb receiving spaces formed on said top surface of said insert, each said halogen bulb receiving space being identical and sufficient in width and length to receive one halogen bulb;

d. at least one halogen bulb end recessed space formed on each said halogen bulb receiving space thereby exposing a terminal end of a halogen bulb when placed into said halogen bulb receiving space to enable a user to grasp the terminal end of a halogen bulb and, e. a halogen bulb longitudinally aligned inside each said halogen receiving space.

* * * * *